United States Patent [19]

Daenen

[11] 4,216,862

[45] Aug. 12, 1980

[54] CHILDREN'S LUNCH BOX

[75] Inventor: Robert H. C. M. Daenen, Hekelgem, Belgium

[73] Assignee: Dart Industries Inc., Los Angeles, Calif.

[21] Appl. No.: 32,062

[22] Filed: Apr. 23, 1979

[51] Int. Cl.[3] ..... A45C 11/20; B65D 25/28

[52] U.S. Cl. ..... 206/541; 206/549; 206/459; 220/4 E; 220/337; 220/94 R; 40/312

[58] Field of Search ..... 206/541, 549, 544, 545, 206/403, 459; 220/4 E, 337, 94 A; 40/10 R, 312, 325

[56] References Cited

U.S. PATENT DOCUMENTS

| | | | |
|---|---|---|---|
| 2,013,852 | 9/1935 | Odendahl | 206/544 |
| 3,285,464 | 11/1966 | Boydman | 220/337 |
| 3,338,464 | 8/1967 | Callihan et al. | 40/312 |
| 3,612,233 | 10/1971 | Nagpal | 206/403 |
| 3,921,798 | 11/1975 | Dean et al. | 40/10 R |

*Primary Examiner*—William T. Dixson, Jr.
*Attorney, Agent, or Firm*—Leigh B. Taylor

[57] ABSTRACT

The lunch box comprises a generally square base container and a correspondingly shaped cover each being integrally formed from the same polymeric material. The base container has an integral handle extending forwardly from one side and integrally formed hinge tabs extending rearwardly from an opposite side. The cover, in turn, has integrally formed hinge blocks with slots for receiving the hinge tabs. The arrangement is such that in open position, the top of the cover is coplanar with the bottom of the base container so that both cover and container can engage a flat surface and function as serving trays for contents in the box. In a second position, wherein the box is closed, the cover is simply swung by flexing of the hinge tabs over the top of the container to close the upper opening. The container and cover openings include cooperating lip and step structures providing an hermetic seal and also frictionally holding the cover in place on the container.

7 Claims, 11 Drawing Figures

CHILDREN'S LUNCH BOX

This invention relates generally to food containers and more particularly to an improved children's lunch box.

BACKGROUND OF THE INVENTION

Children's lunch boxes have usually been made from metal utilizing a conventional box shape with a handle formed on one side and hinges on an opposite side. In addition, there is normally provided some mechanical type of catch on the front portion of the box to hold the lunch box closed. These types of lunch boxes are not only relatively expensive to manufacture, but because metal is used, they are relatively heavy, tend to rust over extended use, can be dangerous to children in exhibiting sharp corners and are easily dented or otherwise damaged if dropped.

Alternatives to the foregoing types of lunch boxes involve simply packaging a child's lunch in a plastic type container with a cover. While this arrangement will serve to hold the lunch and keep it relatively fresh, the container itself is not easy for a child to carry and the cover once separated from the container can readily become lost. Because of these latter problems, it is not uncommon practice to simply package a child's lunch in a brown paper bag and properly identify the lunch by writing the child's name on the bag. This solution, however, also has drawbacks in that no proper sealing of the contents is possible with a simple bag nor is there provided any type of "container" which could function as a serving tray when the child is eating.

BRIEF DESCRIPTION OF THE PRESENT INVENTION

Bearing the foregoing considerations in mind, the present invention contemplates a vastly improved children's lunch box overcoming various problems associated with prior art lunch boxes such as set forth above.

More particularly, in accord with the present invention, the children's lunch box comprises a base container having an upper opening, an integrally formed handle extending from a side of the container below the opening and at least one integrally formed hinge tab extending from an opposite side of the container below the opening. A cover is provided for closing the upper opening of the container, this cover having at least one hinge block integrally formed on a side with a slot receiving the hinge tab.

The base container and cover are each integrally formed of like polymeric plastic material so that they are light, easy-to-clean, and provide a lunch box which is sealed when in closed position and are further so dimensioned and designed that when the cover is swung 180° about the flexible hinge tab to an open position, the top of the cover will be coplanar with the bottom of the container. Both container and cover can thus seat on a flat surface and function as serving trays for food in the box.

Because all parts of the lunch box are plastic, problems associated with rusting and the like are wholly avoided. Moreover, the overall lunch box is light, will not be damaged if dropped, and can be manufactured at a minimum expense as compared to metal structures.

A further feature of this invention resides in the provision of simple identifying means so that a child's name can be readily secured in the box in a visible position and yet protected for substantially the lifetime of the lunch box.

BRIEF DESCRIPTION OF THE DRAWINGS

A better understanding of this invention as well as many further features and advantages thereof will be had by now referring to the accompanying drawings in which.

DETAILED DESCRIPTION OF THE PREFERRED EMBODIMENT

Figure 1:
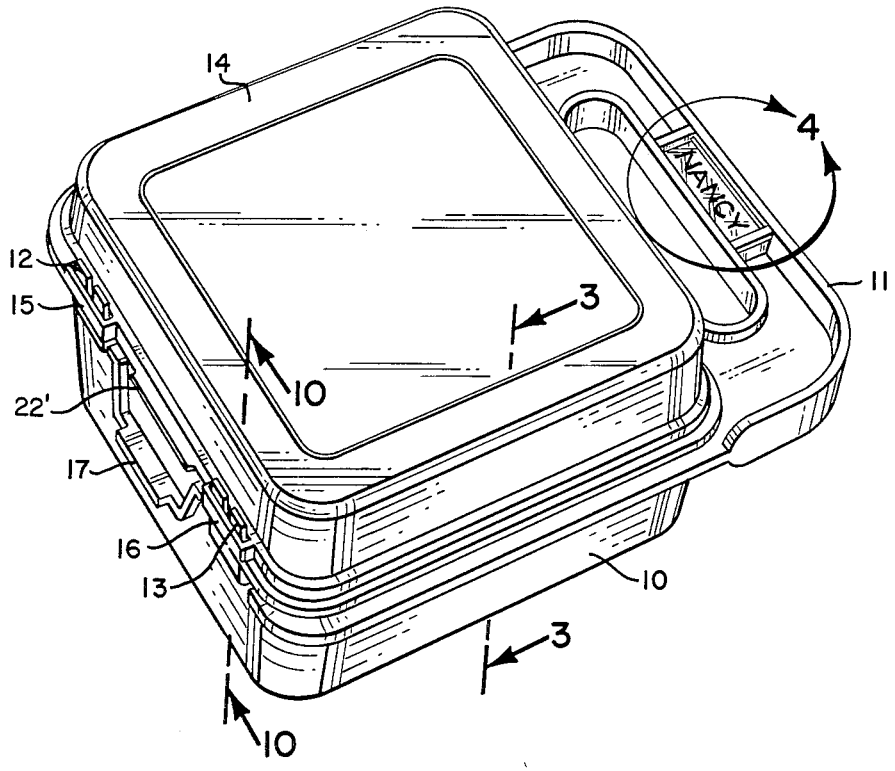
FIG. 1 is a three-fourths rear perspective view of the lunch box of this invention in closed position.

Referring first to FIG. 1, the lunch box comprises a base container 10 having an integrally formed handle 11 extending forwardly from one side as shown. The opposite or rear side of the container 10, in turn, includes at least one and, in the preferred embodiment, two integrally formed hinge tabs 12 and 13 adjacent the rear corners.

Cooperating with the container 10 is a cover 14 for closing the upper opening of the container and including at least one, and in the preferred embodiment shown, two hinge blocks 15 and 16 integrally formed on a rear side of the cover. Each of these blocks has a slot receiving a hinge tab to thereby hinge the cover 14 to the container 10, all as will become clearer as the description proceeds.

Also shown in FIG. 1 is an integrally formed flange structure 17 extending outwardly from the side of the container at a level below the hinge tabs. This flange cooperates with the hinge blocks 15 and 16 when the cover 14 is closed over the container 10 in stabilizing the lunch box when standing in a vertical position.

Figure 2:
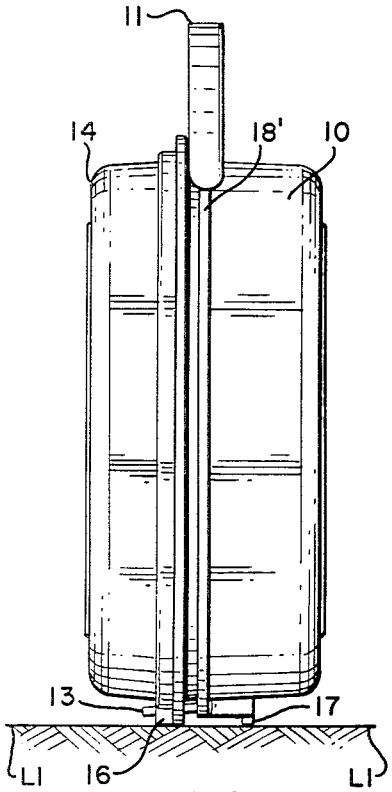
FIG. 2 is an elevational side view of the lunch box standing in a vertical position.

The foregoing will be clearer by referring to FIG. 2 wherein it will be noted that the extended end of the flange 17 is coplanar with the hinge block 15 so as to rest evenly on a flat surface designated by the dashed line L1. The box is thus stabilized when in a vertical standing position shown in FIG. 2 with the handle 11 extending upwardly.

Figure 3:
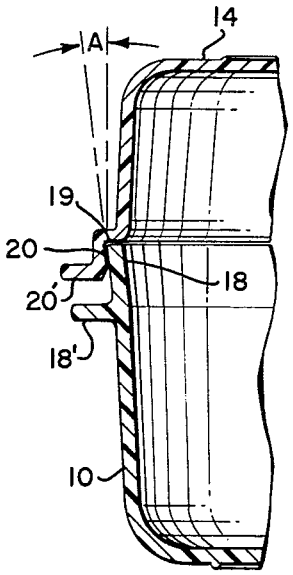
FIG. 3 is a fragmentary cross section taken in the direction of the arrows 3—3 of FIG. 1.

Referring now to the fragmentary cross section of FIG. 3, it will be noted that the base container 10 has an upper opening defined by an upwardly and outwardly extending integrally formed peripheral lip 18. The cover 14, in turn, has a lower opening defined by a peripheral step 19 and outer wall 20 extending downwardly and slightly inwardly from the step. The step and inner surface of the wall are dimensioned to engage the upper end and outer surface of the lip respectively in pressing sealing relationship over the entire perimeter of the openings; that is, over 360°, so that a fully sealed structure results, the cover being frictionally held in its closed relationship on the container and yet readily manually removable to open position.

With respect to the foregoing structure, the container 10 as well as the cover 14 include annular exterior flanges such as indicated at 18' for the container 10 and 20' on the wall portion 20 of the cover 14. As is clear from FIG. 3, the small space between these flanges when the step 19 is fully seated on the top surface of the lip 18 provides a convenient area within which a person can insert his fingers to swing open the cover 14 from the container 10.

In accord with the specific embodiment shown, a means for providing identification of the owner of the lunch box can be formed during the original molding processes in forming the container and cover.

Figure 4:
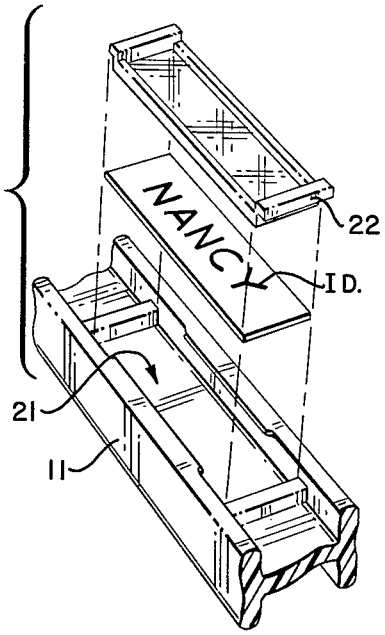
FIG. 4 is a fragmentary exploded perspective view of a portion of the lunch box handle enclosed within the circular arrow 4 of FIG. 1.

More particularly, with reference to the fragmentary exploded perspective view of FIG. 4, it will be noted that the handle 11 has formed therein a depressed area 21. This area 21 can receive an identification card indicated at ID which might contain the child's name; for example, NANCY. A cooperating retaining member 22 which might have a transparent or translucent surface, in turn, is arranged to be press fitted over the ID card when positioned in the tray 21. Retaining member 22 is initially molded as a part of the cover 14 and is simply "torn off" or manually separated from the cover 14 after the molding operation.

With respect to the foregoing, referring once again to FIG. 1, there is shown the remnants of the removal of the retaining member 22 as at 22' between the hinge blocks 15 and 16.

The foregoing tear-away type of identification means consitutes a desirable feature of the present invention as it preserves the simplicity and important characteristic of avoiding any type of metal parts or more than two basic integrally molded members.

Figure 5:
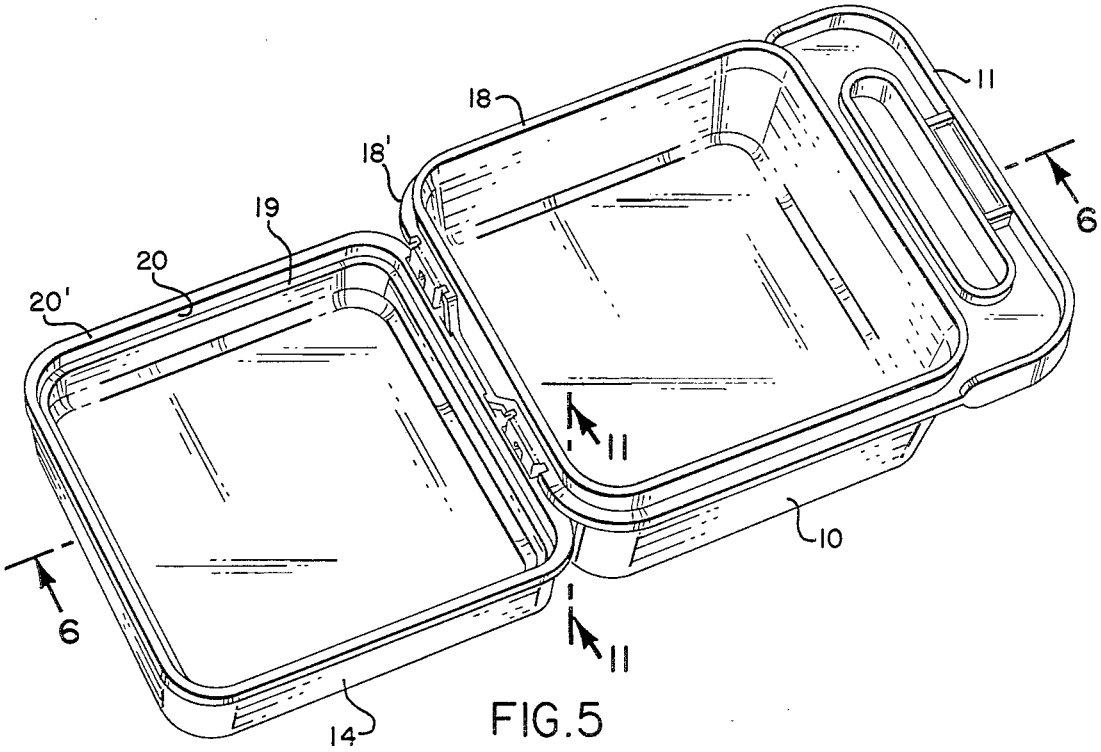
FIG. 5 is a perspective view of the lunch box of FIG. 1 in fully open position.

Referring now to FIG. 5, further features of the lunch box of this invention will become evident.

In FIG. 5, the cover 14 is shown swung through 180° to fully open position. The depth of both the container 10 and cover 14 are such that the top of the cover will be coplanar with the bottom of the container when in the fully open position illustrated in FIG. 5.

From FIG. 5, it will also be noted that in the preferred embodiment of the invention, both the container and cover are essentially square in shape with rounded corners.

Figure 6:
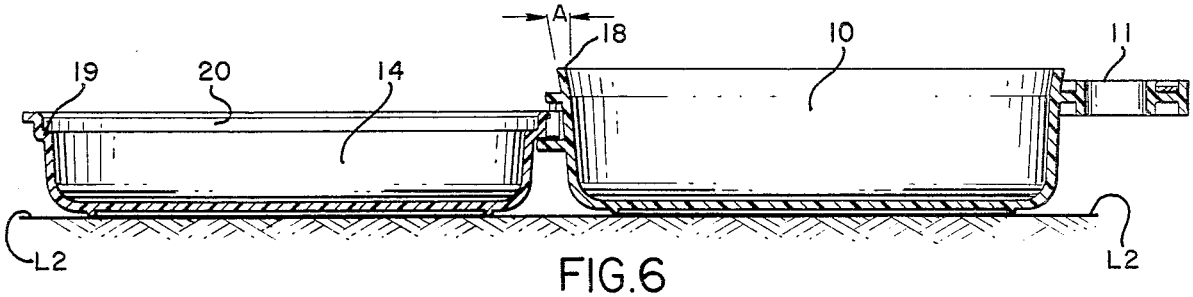
FIG. 6 is a cross section taken in the direction of the arrows 6—6 of FIG. 5.

The feature of a coplanar relationship between the top of the cover and the bottom of the container when in fully open position is clearly illustrated in FIG. 6 wherein the bottom surfaces are resting on a flat surface designated L2.

In the open position of the lunch box as clearly illustrated in both FIGS. 5 and 6, it will be clear that both container and cover function as serving trays for contents within the box when resting on a flat surface.

In FIG. 5, the complete perimeter of the upper opening of the container 10 defined by the lip 18 is clearly shown. Similarly, the complete perimeter of the step 19 and outer wall 20 for the cover 14 is visible.

In FIG. 6, the upward and outwardly biased positioning of the lip 18 which provides for a pressing and sealing relationship when covered by the corresponding wall portion 20 is evident. The angle of the outward extent from the vertical is designated A and may be, for example, about eight degrees with a corresponding inward inclination of eight degrees for the inside of the wall 20 for the cover 14. By providing these inclinations with respect to the vertical, the desired pressing and sealing relationship and frictional retaining of the cover on the container all as described in FIG. 3 will result.

Figure 7:
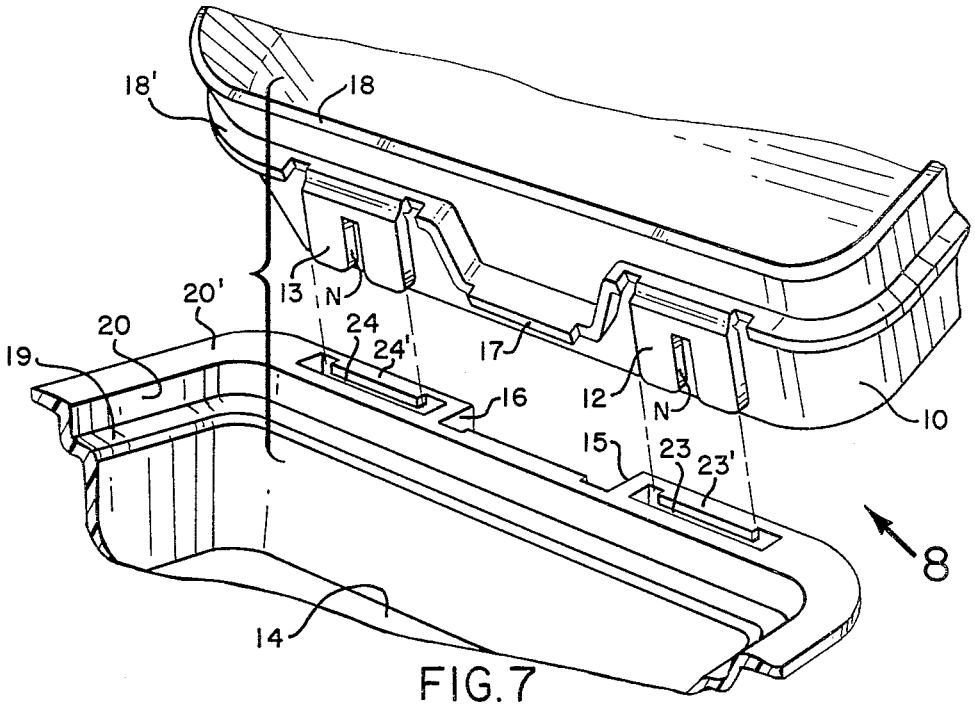
FIG. 7 is a greatly enlarged fragmentary exploded perspective view of the hinge structures for the lunch box of FIG. 5.

Referring now to the enlarged exploded view of FIG. 7, further details of the hinging tabs and hinge blocks in accord with the present invention will be evident. Thus, the slots formed in the hinge blocks 15 and 16 are clearly indicated at 23 and 24 respectively. Also shown are projecting beads 23' and 24' extending from longitudinal edges of the entrance openings of these slots towards the opposite edges. These beads cooperate with corresponding grooves formed on one side of the hinge tabs 12 and 13 as indicated by the dotted lines 12' and 13' in FIG. 7. Essentially, the beads 23', 24' and the grooves 12', 13' constitute cooperating means for retaining the hinge tabs within the slots of the hinge blocks once assembled therein.

Figure 8:
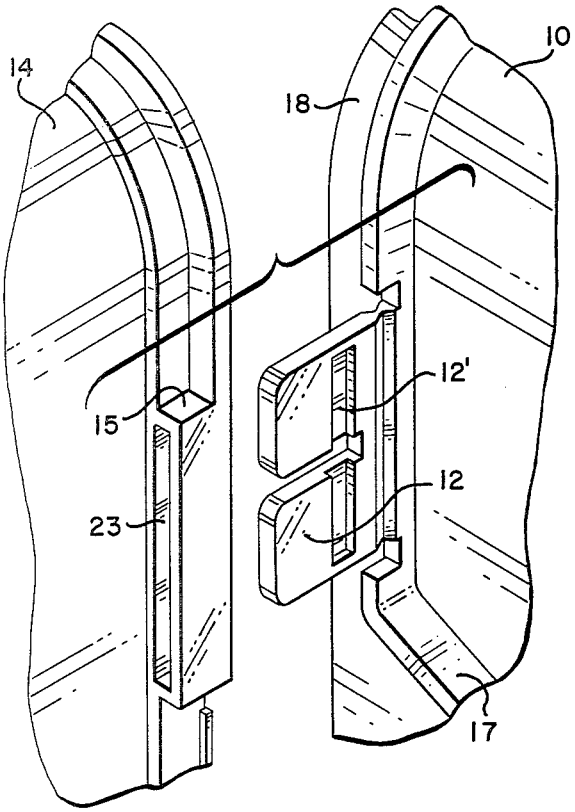
FIG. 8 is another enlarged fragmentary exploded perspective view of one of the hinges looking in the direction of the arrow 8 of FIG. 7.
Figure 9:
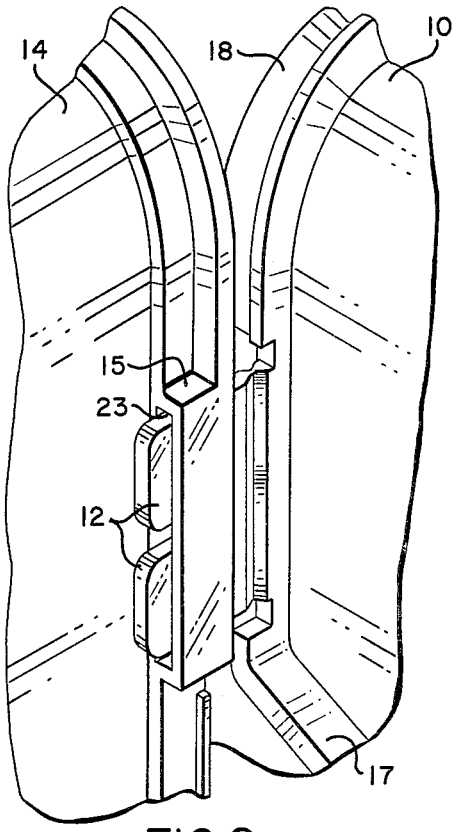
FIG. 9 is a view similar to FIG. 8 but showing the hinge in assembled relationship.

The foregoing will be better understood by referring to the enlarged fragmentary perspective views of FIGS. 8 and 9. Thus, in FIG. 8 there is shown in full lines the longitudinal groove 12' on the underside of the hinge tab 12. As the hinge tab 12 is inserted in the hinge block 13 to pass into the slot 23, the bead projection 23' as described in FIG. 7 will initially be bent over and when the hinge tab 12 is fully inserted as illustrated in FIG. 9, this bead will pop into the groove 12' and thus retain the hinge tab in the block 15. However, by exerting sufficient manual force, the hinge tab can readily be removed from the block when it is desired to completely separate the container from the cover.

Referring back to the perspective view of FIG. 7, it will be noted that each of the hinge tabs 12 and 13 includes a central notch N. This notch permits a squeezing of the side edges of the hinge tabs to squeeze the notch towards a closed position and thus effectively narrow the width of the tabs to facilitate their insertion in the slots 23 and 24 of the hinge blocks. This facilitating of the insertion is desirable when assembling the cover to the container, a slight tilting being desirable so that a first hinge tab such as 12 can be introduced into the slot 23 and thence the second hinge tab 13 introduced into the slot 24. The notches N provide essentially sufficient flexibility to permit the reassembly to be carried out manually without flexing any of the component parts beyond a reasonable amount.

Figure 10:
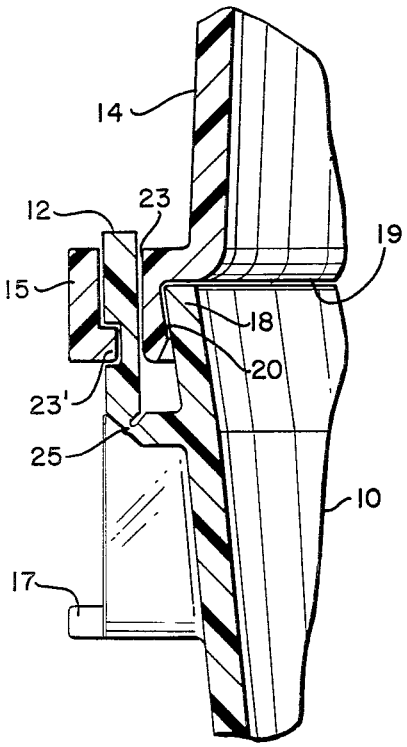
FIG. 10 is a fragmentary cross section of the hinge structure taken in the direction of the arrows 10—10 of FIG. 1.
Figure 11:
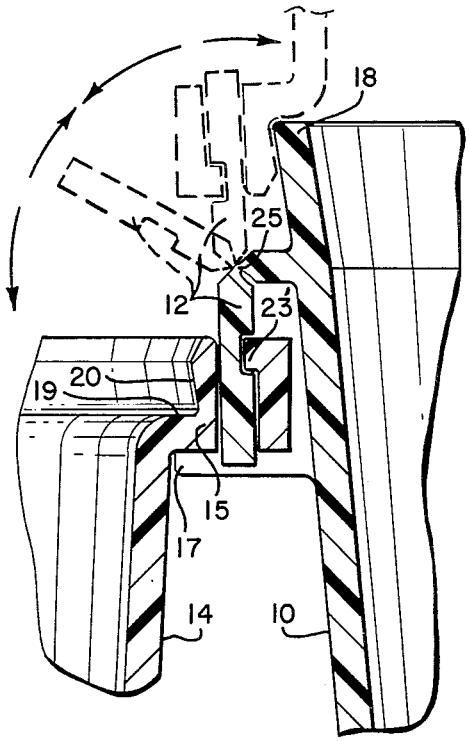
FIG. 11 is another fragmentary cross section of the hinge structure taken in the direction of the arrows 11—11 of FIG. 5.

Referring now to the cross sections of FIGS. 10 and 11, the securement of the hinge tab within the hinge block by the cooperating means in the form of the bead 23' and cooperating groove 12' will be evident. In the closed position of the box as illustrated in FIG. 10, it will be noted that the hinge tab 12 essentially is passing upwardly through the slot 23 in the block 15, the bead 23' being received or snapped into the corresponding groove.

In the showing of FIG. 11 wherein the cover has been lifted from the top of the container and swung through 180°, the hinge tab 12 is extending downwardly through the hinge block 15, again the bead 23' extending into the groove of the hinge tab being clearly visible.

In FIGS. 10 and 11, it will be noted that the hinge tab has a thinned portion 25 adjacent to its integral connection to the container, this thinned portion defining the flexure hinge axis for the tab.

From all of the foregoing, it will be evident that the present invention has provided a greatly improved children's lunch box. Essentially, and as briefly referred to heretofore, the basic box consists solely of two members which may be separately, integrally molded and thence hinged together by simple manual insertion of the integrally formed hinge tabs into the slots of the integrally formed hinge blocks.

The entire structure is light, provides for hermetic sealing of food therein, is not subject to rusting or dents or damage if dropped, and is economical to manufacture. Further, and as also mentioned heretofore, the design is such that the lunch box will easily stand in a vertical position in a stable manner when closed or, when opened, the top of the cover and bottom of the container are in coplanar relationship to provide stability and the further desirable functional aspect of the cover and container serving as trays.

Finally, the unique means for providing a permanent securement of a child's identification to the handle of the box itself avoids the necessity of having to separately tag the box.

While the preferred material of construction for both the container and cover is a high density polymeric material such as a polyethylene, other plastics can be used with equal effectiveness. Further, while only one specific embodiment has been set forth for purposes of illustration, it is to be understood that changes and alterations as fall clearly within the scope and spirit of this invention will occur to those skilled in the art. The lunch box is accordingly not to be thought of as limited to the exact embodiment set forth.

I claim:

1. A children's lunch box comprising, in combination:

(a) a base container having an upper opening;

(b) an integrally formed handle extending forwardly from a side of said container below said opening;

(c) at least one integrally formed hinge tab extending from an opposite side of said container below said opening;

(d) a cover for closing said upper opening of said container;

(e) at least one hinge block integrally formed on a side of said cover and having a slot receiving said hinge tab, said hinge tab having a thin portion adjacent to its integral connection to said container so that it can flex;

(f) cooperating means integrally formed with said hinge tab and block for retaining said tab in said slot under normal hinging movements occurring in the opening and closing of said lunch box, said cooperating means being manually yieldable to permit removal of said tab from said slot when it is desired to physically separate said cover and container; and (g) an integrally formed flange extending outwardly at a level below said hinge tab from said opposite side of said container from which said hinge tab extends such that when said hinge tab is received in said block and said cover is closed over said container, and said lunch box is placed on a flat surface in a vertical standing position with said handle extending upwardly, said flange and block simultaneously engage said flat surface to stabilize the box in said vertical standing position.

2. A lunch box according to claim 1, in which said opposite side of said container from which said hinge tab extends, includes an integrally formed flange extending outwardly at a level below said hinge tab such that when said hinge tab is received in said block and said cover is closed over said container, and said lunch box is placed on a flat surface in a vertical standing position with said handle extending upwardly, said flange and block simultaneously engage said flat surface to stabilize the box in said vertical standing position.

3. A lunch box according to claim 1, in which said upper opening of said container is defined by an upwardly and outwardly extending integrally formed peripheral lip, and in which said cover has a lower opening defined by a peripheral step and outer wall extending downwardly and inwardly from said step, said step and inner surface of said wall being dimensioned to engage the upper end and outer surface of said lip respectively in pressing sealing relationship over 360° when said step is fully seated on the upper surface of said lip so that said cover is frictionally held in closed sealing relationship on said container and yet can be manually swung away from said container to open said box.

4. A lunch box according to claim 1, in which said handle includes a depressed area for receiving an identification card, said cover having integrally molded therewith on its outer wall a retaining member capable of being torn off from said outer wall and received and frictionally retained in said depressed area to hold said identification card in place.

5. A lunch box according to claim 1, in which the depths of said cover and said container are such that the top of said cover is coplanar with the bottom of said container when said cover is swung away from its closed position through 180° so that both cover and container will engage a flat surface in a stable position to expose the contents of the lunch box and function as serving trays.

6. A children's lunch box comprising, in combination:

(a) a base container having an upper opening;

(b) an integrally formed handle extending forwardly from a side of said container below said opening;

(c) at least one integrally formed hinge tab extending from an opposite side of said container below said opening;

(d) a cover for closing said upper opening of said container;

(e) at least one hinge block integrally formed on a side of said cover and having a slot receiving said hinge tab, said hinge tab having a thin portion adjacent to its integral connection to said container so that it can flex;

(f) cooperating means integrally formed with said hinge tab and block for retaining said tab in said slot under normal hinging movements occurring in the opening and closing of said lunch box, said cooperating means being manually yieldable to permit removal of said tab from said slot when it is desired to physically separate said cover and container and including a projecting bead extending from one edge of the entrance opening of said slot towards the opposite edge, said tab having an elongated groove on one side dimensioned to receive said bead, said bead being flexible so that it can bend when said tab is being initially inserted into said slot and thence snapped into said groove when the tab is fully inserted to thereby retain said tab in said slot.

7. A lunch box according to claim 6, in which said container and cover are generally square shaped with rounded corners, each being integrally molded from like polymeric material, said hinge tab being adjacent to one corner of the rear side of said container and there being provided an additional hinge tab adjacent to the other rear side corner of said container, said cover having an additional hinge block for said additional hinge tab, said flange being disposed centrally of the rear corners at said level below said hinge tabs, and wherein each hinge tab portion received in a hinge block slot is notched such that its width can be decreased slightly by squeezing the notch closed to fit within the opposite ends of the slot when assembling the hinging tabs in the slots, whereby separation and assembly of the container and cover are facilitated.

* * * * *